US008584813B2

(12) United States Patent
Talonen et al.

(10) Patent No.: US 8,584,813 B2
(45) Date of Patent: Nov. 19, 2013

(54) ELEVATOR SYSTEM HAVING CAR PANEL WITH ADJUSTABLE VIEWS BASED ON FLOOR DATA, AND METHODS OF OPERATING THE SAME

(75) Inventors: Tapani Talonen, Tervakoski (FI); Niko Rusanen, Helsinki (FI); Vesa Poutiainen, Helsinki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/555,765

(22) Filed: Jul. 23, 2012

(65) Prior Publication Data

US 2012/0325591 A1 Dec. 27, 2012

Related U.S. Application Data

(63) Continuation of application No. PCT/FI2011/050137, filed on Feb. 15, 2011.

(30) Foreign Application Priority Data

Feb. 17, 2010 (FI) ..... 20100062

(51) Int. Cl.
*B66B 1/34* (2006.01)

(52) U.S. Cl.
USPC ..... 187/396; 187/391

(58) Field of Classification Search
USPC ..... 187/247, 380–389, 391–396
See application file for complete search history.

(56) References Cited

U.S. PATENT DOCUMENTS

| | | | | |
|---|---|---|---|---|
| 4,836,336 | A * | 6/1989 | Schroder | 187/384 |
| 5,679,934 | A * | 10/1997 | Juntunen et al. | 187/395 |
| 6,062,346 | A * | 5/2000 | Friedli et al. | 187/395 |
| 6,502,668 | B1 * | 1/2003 | Chida et al. | 187/395 |
| 6,550,587 | B1 * | 4/2003 | Yuasa et al. | 187/394 |
| 6,997,288 | B2 * | 2/2006 | Kakko et al. | 187/391 |
| 7,404,470 | B2 * | 7/2008 | Felder et al. | 187/395 |
| 7,559,408 | B2 * | 7/2009 | Flynn et al. | 187/396 |
| 7,766,129 | B2 * | 8/2010 | Makela et al. | 187/396 |
| 7,793,762 | B2 * | 9/2010 | Zaharia et al. | 187/396 |
| 8,069,957 | B2 * | 12/2011 | Miyajima et al. | 187/391 |
| 8,136,636 | B2 * | 3/2012 | Bahjat et al. | 187/391 |
| 2005/0269164 | A1 | 12/2005 | Tyni et al. | |
| 2007/0272495 | A1 | 11/2007 | Makela et al. | |

FOREIGN PATENT DOCUMENTS

| | | | |
|---|---|---|---|
| EP | 1291311 | A1 | 3/2003 |
| EP | 1386875 | A1 | 2/2004 |
| JP | 06144726 | A * | 5/1994 |
| JP | 2005082299 | A * | 3/2005 |
| JP | 2008127124 | A | 6/2008 |

OTHER PUBLICATIONS

International Search Report and Written Opinion for priority application PCT/FI2011/050137.

* cited by examiner

*Primary Examiner* — Anthony Salata

(74) *Attorney, Agent, or Firm* — Harness, Dickey & Pierce, P.L.C.

(57) ABSTRACT

An elevator system includes at least one elevator serving at least one floor having a collective call panel and at least one second floor having a destination call panel. A plurality of views to be presented in a car panel are recorded in the elevator system, and a view to be presented in the car panel at any given time is selected based on the floor data of the elevator car.

13 Claims, 2 Drawing Sheets

Figure 1:
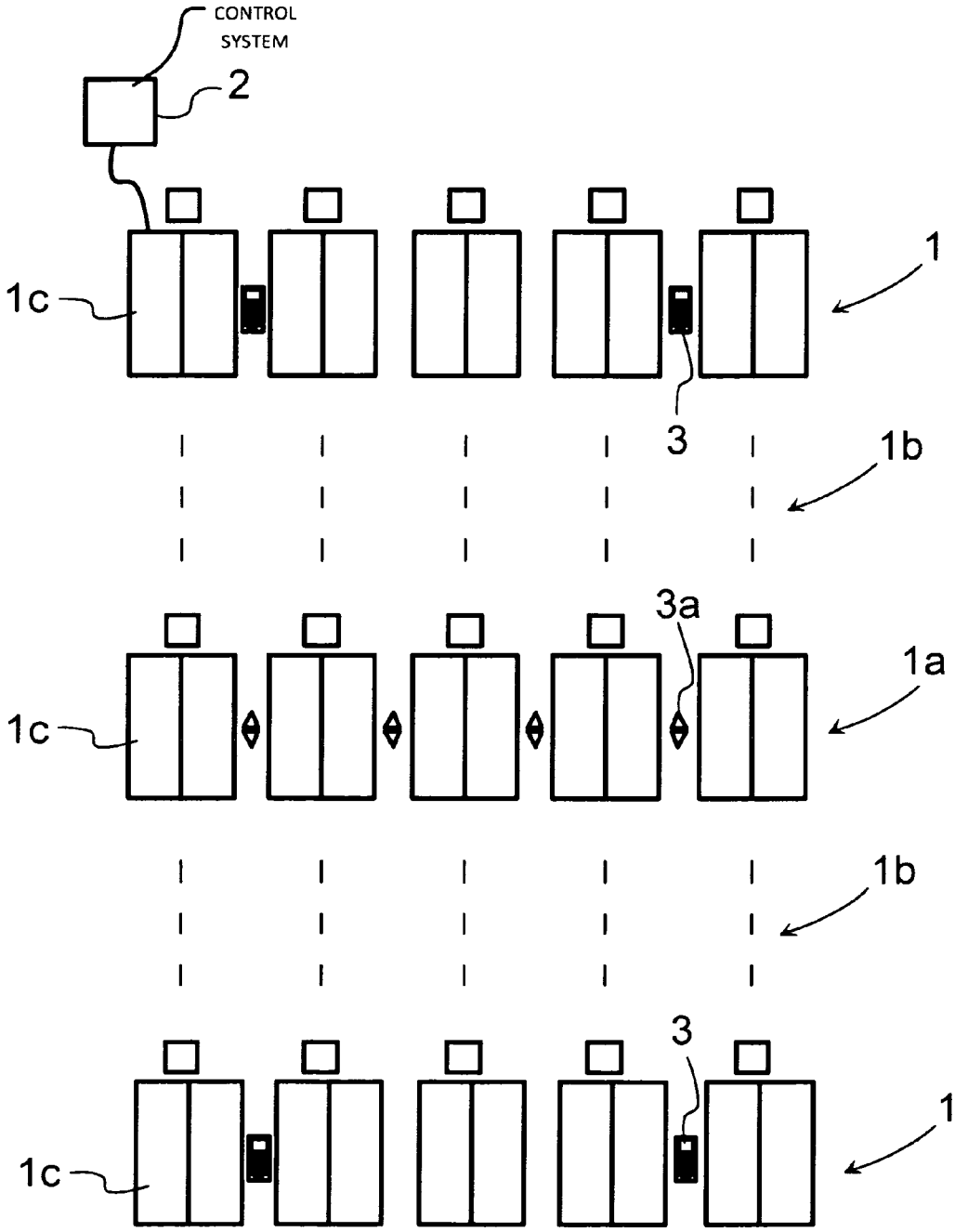

ELEVATOR SYSTEM HAVING CAR PANEL WITH ADJUSTABLE VIEWS BASED ON FLOOR DATA, AND METHODS OF OPERATING THE SAME

CROSS-REFERENCE TO RELATED APPLICATIONS

This is a Continuation of PCT/FI2011/050137 filed on Feb. 15, 2011, which is an International Application claiming priority from FI 20100062 filed on Feb. 17, 2010; the entire contents of each of which are hereby incorporated by reference.

FIELD OF THE INVENTION

The invention relates to elevator systems. More particularly the invention relates to the floor-specific control of call panels that are in elevator cars in elevator systems, in which for the giving of calls some floors comprise a destination call panel and some other floors comprise conventional up call buttons and down call buttons.

BACKGROUND OF THE INVENTION

When the floor level served by an elevator system has a destination call panel, the elevator cars do not need floor call buttons intended for floor calls. Correspondingly, on a floor level that only has up call buttons or down call buttons floor call buttons are needed in the elevator cars so that an elevator passenger could give a floor call in the elevator car to destination floor he/she desires. As a result of the arrangement in question, on the floors which comprise up-down call buttons a passenger must give a floor call in the elevator car whereas on the other floors, which comprise destination call panels, he/she does not need to give a floor call in the elevator car which easily causes unnecessary uncertainty and confusion in the giving of calls and thus makes the arrival of the passenger at his/her destination more difficult.

Attempts have been made to solve the problem by, among other things, locking (passivating) the floor call buttons of a car panel when the elevator car is at floors that have a destination call panel. A problem in these prior-art solutions is, however, that because the floor call buttons of the car panel are visible, although they are locked, the floor call buttons of the car panel cause confusion amongst the passengers arriving in the elevator car from floor levels provided with destination call panels. The confusion arises from passengers being unsure of whether they should still press floor call button of the car panel even though they have indicated their destination floor by means of a destination call panel on a floor level. Since a locked floor call button does not react when pressed, it can cause even more confusion in a passenger if he/she presses a locked floor call button.

The same basic problem causing the confusion is also in those prior-art solutions in which the floor call buttons of the car panel are not locked when the elevator car is at floor levels provided with destination call panels. In this case some of the passengers can refrain from giving a destination call on a floor level, move into some elevator car that is stopping or has stopped at the floor level, and indicate their destination floor only by pressing a floor call button in the elevator car. As a consequence the optimal routing and allocation of calls of the elevators suffers, in which case the transport capacity of the elevator system, particularly in peak hours, can be reduced and some passengers who have given a destination call can even be forced to stay on a floor level because there is not room in the elevator car owing to the "surplus" passengers.

PURPOSE OF THE INVENTION

The aim of this invention is to eliminate or at least to mitigate the aforementioned drawbacks and to achieve a simple and inexpensive solution, which is graphical for users, for controlling a car panel of an elevator car. Example embodiments provide elevator systems and methods of operating the same.

Some inventive embodiments are also discussed in the descriptive section of the present application. The inventive content of the application can also be defined differently than in the claims presented below. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts. Likewise the different details presented in connection with each embodiment of the invention can also be applied in other embodiments. In addition, it can be stated that at least some of the subordinate claims can in at least some situations be deemed to be inventive in their own right.

SUMMARY OF THE INVENTION

The present invention presents a method for controlling a car panel of an elevator car in an elevator system, which comprises at least one elevator, which serves at least one floor comprising a collective call panel and at least one second floor comprising a destination call panel. The method comprises the phases: a plurality of floor-specific views to be displayed in the car panel are determined; up-to-date floor data of the elevator car is determined; and the view to be presented in the car panel is selected from the aforementioned plurality of views on the basis of the aforementioned floor data. A collective call panel in this context refers to a conventional call-giving device on a floor level, which device comprises one or preferably two call buttons (up/down call buttons) for calling the elevator car to a floor level. A destination call panel refers to a call-giving device on a floor level, by means of which device a passenger indicates his/her destination floor already while on the departure floor before moving into the elevator car. Floor-specific views can be recorded in the control system of the elevator system or in the floor call panels as graphic presentations and/or as parametric data, on the basis of which the views are generated with software. On a floor comprising a destination call panel, a view in which the floor call buttons are concealed or dimmed is primarily selected, whereas on a floor comprising a collective call panel, a view in which one or more floor call buttons are on show is primarily selected. If a floor call button is concealed or dimmed, a passenger cannot give a call connected to the floor call button in question in the elevator car. Correspondingly, if the floor call button is on show, a passenger in the elevator car can give a call by pressing the floor call button in question. The floor data comprises information about the floor at which the elevator car is and/or at which the elevator car will next stop on the basis of the calls given. The floor data is updated according to when the elevator car conducts runs between floors and/or when passengers give calls on the floor levels and in the elevator car, in other words the floor data of the elevator car is up-to-date (real-time) data about the position and/or the next stopping floor of the elevator car.

The present invention also discloses an elevator system, which comprises a control system and at least one elevator, the elevator car of which comprises at least one call panel. At least one floor served by the elevator comprises a collective call panel and at least one second floor comprises a destination call panel. A plurality of views to be presented in a car panel are recorded in the elevator system and the control system is arranged to determine up-to-date floor data of the elevator car and to select the view to be presented in the car panel from the aforementioned plurality of views on the basis of the floor data.

In one embodiment of the invention a floor-specific view is selected in the phase when the elevator car arrives at a floor level, at the latest in connection with the opening of the doors of the elevator car. Alternatively a floor-specific view can be selected in the phase when the elevator car leaves a floor level, at the latest in connection with the closing of the doors of the elevator car.

In one embodiment of the invention additional information is presented to passengers in the car panel in the pushbutton area that comprises concealed or dimmed floor call buttons.

In one embodiment of the invention a floor-specific view is selected on the basis of additional information, which is one or more of the following information items: the time of day, the date, information specifying the locked floors, identifier data that identifies a passenger.

One advantage of the solution according to the invention is that the floor call buttons of car panels on floor levels provided with destination call panels are completely concealed or so clearly marked as locked or out-of-use that no confusion arises amongst the passengers in an elevator car about the use of floor call buttons. Another advantage is that e.g. additional information can be presented in place of floor call buttons in car panels provided with a touch-sensitive display. This type of additional information can be e.g. clarifying information about the locking of floor call buttons, an indication of the next stopping floors, weather information and/or another notification suitable to the situation. Another advantage is that in a car panel provided with a touch-sensitive display there is a possibility to obtain savings in the consumption of energy when the floor call buttons are concealed and the display can be in energy-saving mode. By changing the floor-specific views of the car panel according to the time of day and/or the date, the access control of the building can be improved and a generally better transport service can be offered to passengers. The access control can also be improved by allowing only identified passengers access to locked floors by bringing into sight only those floor call buttons for which a passenger has an access permit.

LIST OF FIGURES

Figure 2:
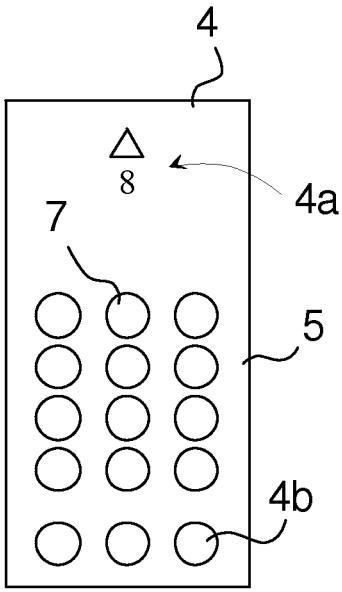
Figure 3:
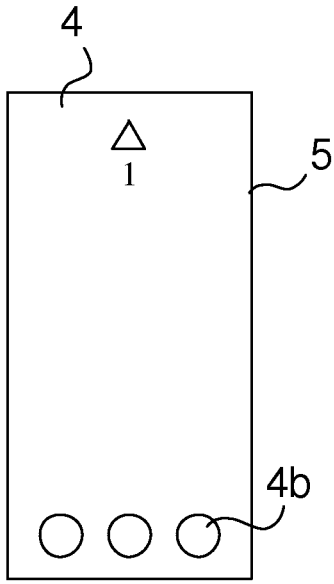
Figure 4:
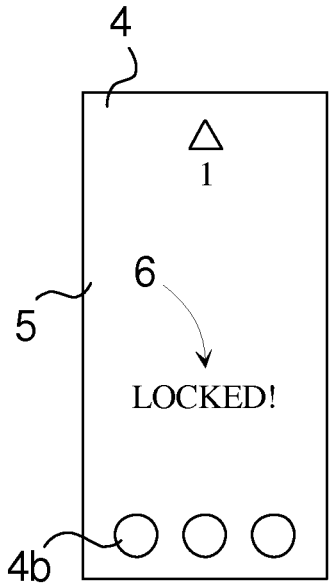
Figure 5:
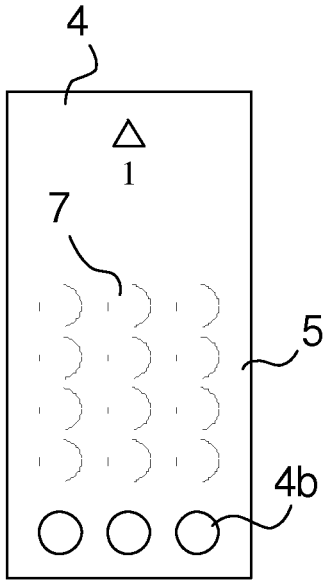
Figure 6:
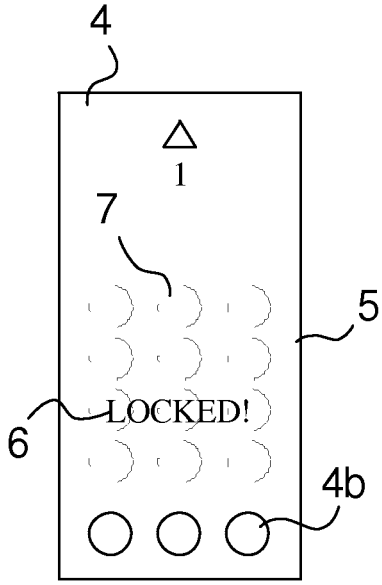

In the following, the invention will be described in more detail by the aid of examples of its embodiment with reference to the attached drawings, wherein FIG. 1 presents a simplified and diagrammatic view of an elevator system comprising a number of elevators that are next to each other, FIG. 2 presents one car panel according to the invention in an elevator car, the floor call buttons in which car panel are visible, FIG. 3 presents one car panel according to the invention in an elevator car, the floor call buttons in which car panel are concealed, FIG. 4 presents one car panel according to the invention in an elevator car, the floor call buttons in which car panel are concealed and the car panel comprises a locking notification of the floor call buttons, FIG. 5 presents a second car panel according to the invention in an elevator car, the floor call buttons in which car panel are dimmed, and FIG. 6 presents a second car panel according to the invention in an elevator car, the floor call buttons in which car panel are dimmed and the car panel comprises a locking notification of the floor call buttons.

DETAILED DESCRIPTION OF THE INVENTION

FIG. 1 presents an elevator system, in which the solution according to the invention is applied. The elevator system comprises five elevators that are next to each other, which are described by the elevator doors 1*c* that are on the floor levels 1 and 1*a*. The elevators are connected to a control system 2, which receives the calls given by passengers on the floor levels and in the elevator cars and which controls the elevators of the control system on the basis of the calls given. The control system comprises one or more control units (e.g. a group control and elevator-specific controls) as well as the sensors needed for achieving the aforementioned control procedures. The entrance floor and the topmost floor, which in this case comprise destination call panels 3, are marked with the reference number 1. The floors 1*a* comprise destination call panels at their simplest, so-called collective call panels 3*a*, with the call buttons of which a passenger can order an elevator to the call floor and also at the same time indicate his/her direction of travel (upward direction or downward direction). The other floors, which are presented with dashed lines 1*b*, can be floors provided with either destination call panels 3 or with collective call panels 3*a*.

FIG. 2 presents one car panel 4 to be used in the solution according to the invention, which car panel is provided with e.g. a touch-sensitive display and comprises e.g. a floor indicator 4*a*, provided with a direction arrow, and special buttons 4*b*, such as an opening button and/or closing button of the elevator door 1*c* as well as an alarm button or stop button. The floor indicator 4*a* and the special buttons 4*b* are always visible irrespective of which floor level the elevator car is at. In addition, the car panel 4 comprises floor call buttons 7 in the pushbutton area 5, with which floor call buttons the elevator car can be controlled to go to the desired floor.

The solution according to the invention presents in the car panels 4 in elevator cars floor-specific views, i.e. layouts, in which e.g. the floor call buttons 7 are either visible or they are dimmed or concealed. Each floor level 1, 1*a* can have a different view presented in a car panel 4, which view depends on the floor level in question and is also appropriate for exactly the floor level in question. For this purpose information about floor-specific views is recorded in the control system and/or in the car panels, from which views the control system selects the view to be presented in the car panel on the basis of the floor data of each elevator car. Floor-specific views can be recorded in the control system or in a car panel either directly as a graphic presentation and/or as parametric data, on the basis of which the views to be presented can be generated with software. It is possible to set in the parameters e.g. which of the floor call buttons are on show for each specific floor, which are either concealed or dimmed, and/or which floors comprise a destination call panel and which floors comprise a collective call panel. At least one view is set per each floor but there can also be a number of floor-specific views, from which the control system selects the view to be presented on the basis of the floor data and on the basis of the desired additional information, such as e.g. on the basis of the time of day, the date, the locking data of the floors or the identifier data that identifies passengers.

As stated before, the locked floors to which passengers do not have access without a personal identifier, such as a magnetic card or an RFID (radio frequency identifier) containing the identifying code (ID code) of the passenger, have been taken into account in the floor-specific views. The view of the car panel 4 of an elevator car can e.g. request a passenger to use his/her identifier in the reading device (not shown) that is in connection with the car panel, after which the concealed or dimmed floor call buttons of the locked floors come into sight for the locked floors enabled by the identifier, i.e. those floors for which the "owner" of the identifier has access rights. For checking access rights the elevator system comprises an access control system, in which the identification data of each passenger as well as the access rights of the passenger at any given time are recorded. The access control system can be integrated as a part of the control system or it can be a separate access control system connected to the control system via a data transfer connection. Alternatively, access rights can be recorded in the identifier of a passenger, in which case a separate access control system is not needed. The information about locked floors is recorded either in the control system and/or in the access control system, from where the information is available to the control system.

As stated above, the views to be presented in the call panels can also depend on the time of day and/or on the date. For example, at weekends certain floors can be locked floors, to which it is not possible to travel without a proper identifier whereas on weekdays the locking is not used. The control system comprises a calendar clock, on the basis of which the control system has information about the time of day and about the date at that moment, on the basis of which the desired view can be selected.

FIG. 2 presents a situation in which the elevator car is at some floor level 1*a* comprising a collective call panel 3*a*. Since information about the destination floor cannot be given on the floor level 1*a* in question, it must be given in the elevator car. In this case when the elevator car is at the floor level in question, the floor call buttons 7 in the car panel 4 are visible so that the call needed can be given in the elevator car.

FIG. 3 presents a situation in which the elevator car is at some floor level 1 provided with a destination call panel 3. In this case the floor call buttons 7 in the pushbutton area that is in the car panel 4 in the elevator car are concealed from view because the passenger has given information about his/her destination floor already in connection with giving the call on the floor level and that being the case the floor call buttons are not needed for giving a call. FIG. 4 presents a situation corresponding to FIG. 3, however such that for further certainty the text "Locked!" is written as additional information in the pushbutton area 5, which text indicates to passengers that the floor call buttons 7 are not right now in use.

FIG. 5 further presents a situation in which the elevator car is at some floor level 1 provided with destination call panels 3. In this embodiment the floor call buttons 7 in the pushbutton area 5 that is in the car panel 4 are dimmed to be more weakly visible so that passengers in the elevator car would understand that the floor call buttons 7 are not in use and it is not necessary to press them. FIG. 6 presents a situation corresponding to FIG. 5, however such that for additional certainty the text "Locked!" is written as additional information in the pushbutton area 5, which text makes it clear to a passenger that the destination floor buttons 7 are not right now in use.

For controlling the car panel in the desired manner at least the floor data specific to each elevator car is needed, i.e. the information about the floor at which the elevator is at any given time and/or information about the floor at which the elevator car will next stop, so that the desired floor-specific view can be selected (and at the same time presented) in the car panel (4) of the elevator car. The point in time of the selection and presentation of the view can be made more precise with door data, i.e. with data about when the elevator door will open and close. As stated before, also the time of day, the date, the locked floors and/or the identifier data of a passenger can be taken into account in the selection of the view. The information needed in the selection of a view is collected into the elevator system e.g. by means of various sensors or monitoring devices, where e.g. the information in the control system 2 is analyzed and utilized in the selection of the view to be presented in the car panel 4.

The control system can e.g. determine the departure floor and the next stopping floor of the elevator car from the floor data and on the basis of the door data of the elevator car the control system can monitor the starting of the elevator car from the departure floor and the arrival of the elevator car at the stopping floor. In this case the opening or closing of the elevator door is detected by means of suitable sensors and information about the opening or closing of the doors is delivered to the control system 2. The closing of the doors is a sufficient sign of the starting of the elevator car and correspondingly the opening of the doors is a sufficient sign of the arrival of the elevator car at a floor level. When the departure floor of the elevator car is a floor level 1*a* provided with a collective call panel 3*a*, in which case the floor call buttons 7 in the view of the car panel 4 of the elevator car are visible, the floor call buttons can already be concealed or dimmed when the elevator car starts moving towards the next stopping floor which is a floor level 1 provided with destination call panels 3. The concealment or dimming is implemented in this case e.g. after the elevator doors have closed. Alternatively the visible floor call buttons 7 of a car panel 4 can be concealed or dimmed only when the elevator car arrives at a floor level 1 provided with destination call panels 3 and the elevator doors open.

Correspondingly, when the departure floor of the elevator car is a floor level 1*a* provided with a destination call panel 3*a*, in which case the floor call buttons 7 in the view of the car panel 4 of the elevator car are concealed or dimmed, the floor call buttons 7 are returned into sight already when the elevator doors close and the elevator car leaves from a floor level 1 provided with destination call panels 3 and the next stopping floor is a floor level 1*a* provided with collective call buttons 3*a*. Alternatively the concealed or dimmed floor call buttons 7 of a car panel 4 can be returned into sight in the view of the car panel 4 when the elevator car arrives at a floor level 1*a* provided with a collective call panel 3*a* and the elevator doors open.

It is obvious to the person skilled in the art that the invention is not limited solely to the examples described above, but that it may be varied within the scope of the claims presented below. Thus, for example, the floor call buttons in the elevator car can be concealed or covered mechanically, e.g. with a protective lid. Also a separate identifier means is not necessarily needed for identifying a passenger either, but instead a passenger can be identified on the basis of a bio-identifier, e.g. on the basis of a fingerprint. It is also obvious to a person skilled in the art that if the elevator is a so-called multicar elevator, different views to each other can be presented simultaneously in the call panels of its different cars according to the principles presented above.

It is further obvious to the person skilled in the art that the different phases of the method can be in a different sequence to each other than what is described above and there can be a different number of phases than what is presented above.

The invention claimed is:

1. A method for controlling a car panel of an elevator car in an elevator system including at least one elevator serving at least one first floor having a collective call panel and at least one second floor having a destination call panel, the method comprising:

determining a plurality of views to be presented on the car panel;

selecting, for a floor served by the at least one elevator, a view from the plurality of views to be presented on the car panel based on a type of call panel at the floor.

2. The method according to claim 1, wherein the selecting comprises:

selecting a view in which one or more floor call buttons are at least one of concealed and dimmed if the call panel at the floor is the destination call panel.

3. The method according to claim 1, wherein the selecting comprises:

selecting a view in which one or more floor call buttons are shown if the call panel at the floor is the collective call panel.

4. The method according to claim 1, wherein a view is selected, at the latest, in connection with opening of elevator doors when the elevator car stops at the floor.

5. A method for controlling a car panel of an elevator car in an elevator system including at least one elevator, the elevator car having at least one car panel, and the at least one elevator serving at least one first floor including a collective call panel and at least one second floor including a destination call panel, the method comprising:

determining a plurality of views to be presented on the car panel;

determining up-to-date floor data for the elevator car;

selecting a view to be presented on the car panel from the plurality of views based on the up-to-date floor data; wherein a view according to a next stopping floor is selected at a departure floor in connection with closing of elevator doors.

6. The method according to claim 2, wherein additional information is presented to passengers in a pushbutton area when the one or more floor call buttons are at least one of concealed and dimmed.

7. The method according to claim 1, wherein a floor-specific view is selected based on additional information, the additional information including at least one of a time of day, a date, information specifying locked floors, and identifier data identifying a passenger.

8. An elevator system, which comprising:

a control system;

at least one elevator including an elevator car having at least one car panel;

wherein a plurality of views to be presented on the car panel are recorded in the elevator system; and wherein the control system is configured to, select, for a floor served by the at least one elevator, a view to be presented on the car panel from the plurality of views based on a type of car panel at the floor.

9. The elevator system according to claim 8, wherein the control system is configured to monitor opening of elevator doors and to select the view, at the latest, in connection with the opening of the elevator doors when the at least one elevator stops at the floor.

10. An elevator system, comprising:

a control system;

at least one elevator including an elevator car having at least one car panel;

wherein the at least one elevator is configured to service at least one first floor having a collective call panel and at least one second floor having a destination call panel;

wherein a plurality of views to be presented on the at least one car panel are recorded in the elevator system; and wherein the control system is configured to, determine up-to-date floor data for the elevator car, select a view to be presented on the at least one car panel from the plurality of views based on the up-to-date floor data, monitor closing of elevator doors, and select the view according to a next stopping floor in connection with the closing of the elevator doors at the floor.

11. The elevator system according to claim 8, wherein the control system is configured to select a floor-specific view based on additional information, the additional information including at least one of a time of day, a date, passenger identifier data, and information specifying locked floors.

12. The method of claim 1, wherein the type of car panel is one of the collective call panel and the destination call panel.

13. The elevator of claim 8, wherein the type of car panel is one of the collective call panel and the destination call panel.

* * * * *

UNITED STATES PATENT AND TRADEMARK OFFICE

CERTIFICATE OF CORRECTION

PATENT NO. : 8,584,813 B2
APPLICATION NO. : 13/555765
DATED : November 19, 2013
INVENTOR(S) : Tapani Talonen It is certified that error appears in the above-identified patent and that said Letters Patent is hereby corrected as shown below:

On the Title Page, Item (54) and in the Specification, at Column 1, lines 1-4, Title, should read --ELEVATOR SYSTEMS HAVING CAR PANEL WITH ADJUSTABLE VIEWS BASED ON FLOOR DATA, AND METHODS OF OPERATING THE SAME--

Signed and Sealed this
Twenty-fifth Day of February, 2014

Michelle K. Lee

Michelle K. Lee
*Deputy Director of the United States Patent and Trademark Office*